US009602913B2

(12) United States Patent
Huang

(10) Patent No.: US 9,602,913 B2
(45) Date of Patent: Mar. 21, 2017

(54) DUAL-FREQUENCY COAXIAL HEADPHONE

(71) Applicant: Jetvox Acoustic Corp., Taoyuan (TW)

(72) Inventor: To-Teng Huang, Taoyuan (TW)

(73) Assignee: JETVOX ACOUSTIC CORP., Taoyuan (TW)

( * ) Notice: Subject to any disclaimer, the term of this patent is extended or adjusted under 35 U.S.C. 154(b) by 11 days.

(21) Appl. No.: 14/725,461

(22) Filed: May 29, 2015

(65) Prior Publication Data

US 2016/0212521 A1 Jul. 21, 2016

(30) Foreign Application Priority Data

Jan. 16, 2015 (TW) ..... 104200801 U

(51) Int. Cl.
*H04R 1/10* (2006.01)
*H04R 1/24* (2006.01)
*H04R 5/033* (2006.01)

(52) U.S. Cl.
CPC ..... *H04R 1/24* (2013.01); *H04R 1/1008* (2013.01); *H04R 5/033* (2013.01)

(58) Field of Classification Search
CPC ..... H04R 1/24; H04R 1/1008
See application file for complete search history.

(56) References Cited

U.S. PATENT DOCUMENTS 8,077,898 B2 * 12/2011 Huang ..... H04R 1/1016 381/186
2010/0046783 A1 * 2/2010 Huang ..... H04R 1/1075 381/380
2014/0169583 A1 * 6/2014 Huang ..... H04R 1/24 381/74
2015/0373460 A1 * 12/2015 Huang ..... H04R 1/02 381/190

* cited by examiner

*Primary Examiner* — Regina N Holder
(74) *Attorney, Agent, or Firm* — Muncy, Geissler, Olds & Lowe, P.C.

(57) ABSTRACT

A dual-frequency coaxial headphone including a headphone housing, a low-frequency speaker unit, and a high-frequency speaker unit. The headphone housing includes an accommodating space and a sound output hole. The accommodating space is communicated with the sound output hole. The low-frequency speaker unit is positioned in the accommodating space. The low-frequency speaker unit includes a housing and a low-frequency diaphragm disposed on the housing. The low-frequency diaphragm faces toward the sound output hole and includes a central through hole and an annular vibrating portion around the central through hole. The low-frequency diaphragm produces low-frequency sound waves toward the sound output hole by vibrations of the annular vibrating portion. The high-frequency speaker unit is disposed on the housing and is positioned in the central through hole. The high-frequency speaker unit is coaxial to the central through hole.

13 Claims, 6 Drawing Sheets

DUAL-FREQUENCY COAXIAL HEADPHONE

CROSS-REFERENCES TO RELATED APPLICATIONS

This non-provisional application claims priority under 35 U.S.C. §119(a) on patent application Ser. No. 104200801 filed in Taiwan, R.O.C. on 2015 Jan. 16, the entire contents of which are hereby incorporated by reference.

BACKGROUND

Technical Field

The instant disclosure relates to a headphone, and more particularly, to a dual-frequency coaxial headphone.

Related Art

As shown in FIG. 1, FIG. 1 is a side view of a headphone structure of prior arts. The headphone structure A of prior arts includes a signal line A1, a diaphragm A2, a permanent magnet A3, a voice coil A4, a magnetic component A5, and a yoke A6 all disposed in a headphone housing A10. The voice coil A4 is assembled to the diaphragm A2 and surrounds a periphery of the permanent magnet A3. A radial gap is kept between the voice coil A4 and the magnetic component A5. The permanent magnet A3 is sandwiched between the magnetic A5 and the yoke A6.

The signal line A1 is electrically connected to voice coil A4. When sound signals are inputted to the voice coil A4, the voice coil A4 generates magnetic fields according to the electromagnetic effect. The magnetic fields magnetically interact with the magnetic component A5 to have the diaphragm A2 vibrate such that the sound signals are converted to sound waves.

Generally, sound signals include high-frequency and low-frequency ranges for producing high-frequency and low-frequency sound waves by the vibration of the same diaphragm A2 of the prior headphone structure A. The high-frequency and low-frequency sound waves have different properties such as different wave lengths and amplitudes. Properly converting high-frequency and low-frequency signals to high-frequency and low-frequency sound waves having clear and distinct properties by merely the same diaphragm A2 is difficult. Therefore, sound converting process of the prior headphone structure A often causes intermodulation distortion between high frequencies and low frequencies. Prior arts also require frequency dividers for frequency division. Another issue of prior arts is that the material composed of the diaphragm A2 is uniform, which is not suit for converting different ranges of frequencies. A diaphragm properly produces high-frequency sound waves by faster vibrating and lower amplitudes. To a certain extent, the harder the material of the diaphragm, the better the high-frequency sound quality. In contrast, a diaphragm properly produces low-frequency sound waves by slower vibrating with longer wave lengths. To a certain extent, the softer the material of the diaphragm, the better the low-frequency sound quality. In other words, full range frequency sound waves produced by the single diaphragm A2 has mediocre quality. Features with respect to high-frequency and low-frequency sound waves are hard to be respectively emphasized. As a result, the produced sounds are not clear and distinct.

SUMMARY

To address the above issue, the instant disclosure provides a dual-frequency coaxial headphone comprising a headphone housing, a low-frequency speaker unit, and a high-frequency speaker unit. The headphone housing comprises an accommodating space and a sound output hole. The accommodating space is communicated with the sound output hole. The low-frequency speaker unit is positioned in the accommodating space. The low-frequency speaker unit comprises a speaker unit housing and a low-frequency diaphragm disposed on the speaker unit housing. The low-frequency diaphragm faces toward the sound output hole and comprises a central through hole and an annular vibrating portion around the central through hole. The low-frequency diaphragm produces low-frequency sound waves toward the sound output hole by vibrations of the annular vibrating portion. The high-frequency speaker unit is disposed on the speaker unit housing and is positioned in the central through hole. The high-frequency speaker unit is coaxial to the central through hole. One face of the high-frequency speaker unit produces high-frequency sound waves toward the sound output hole and concentrating in a central area of the low-frequency sound waves. The other face of the high-frequency speaker unit faces toward the inner of the headphone housing.

According to an embodiment, one face of the high-frequency speaker unit and one face of the low-frequency speaker unit are in a same plane.

According to an embodiment, the headphone housing comprises a body, a speaker mount covering the body, and an ear pad covering the speaker mount. The accommodating space is formed in the body. The sound output hole is disposed in the centre of the speaker mount.

According to an embodiment, the speaker unit housing comprises a case and a protective net. The protective net covers the low-frequency diaphragm so that the low-frequency diaphragm is against the case.

According to an embodiment, the protective net comprises a coupling hole corresponding to the central through hole. The high-frequency speaker unit is disposed in the coupling hole.

According to an embodiment, a gap for air flowing is formed between the coupling hole and the high-frequency speaker unit.

According to an embodiment, the high-frequency speaker unit comprises a speaker unit housing and a high-frequency diaphragm disposed on the speaker unit housing. The speaker unit housing of the high-frequency speaker unit comprises a case and a protective net. The protective net covers the high-frequency diaphragm so that the high-frequency diaphragm is against the case. The high-frequency speaker unit comprises a guiding tube. One side of the guiding tube surrounds and is coupled to the speaker unit housing of the high-frequency speaker unit, and the other side of the guiding tube extends to the accommodating space.

According to an embodiment, the high-frequency speaker unit further comprises a washer and an annular magnet. The annular magnet is positioned in the case. The washer is positioned on a surface of the annular magnet. The high-frequency speaker unit further comprises a fixing ring positioned in the case and against a periphery of the high-frequency diaphragm. In addition, the high-frequency speaker unit further comprises a voice coil assembled to the high-frequency diaphragm. The voice coil surrounds and is coupled to the washer.

According to an embodiment, the low-frequency speaker unit further comprises a washer, an annular magnet, and an outer yoke. The annular magnet is positioned in the outer yoke. The washer is positioned on a surface of the annular magnet. The low-frequency speaker unit further comprises a voice coil assembled to the low-frequency diaphragm. The voice coil surrounds and is coupled to the washer. In addition, the low-frequency speaker unit further comprises a circuit board disposed in the accommodating space and electrically connected to the outer yoke.

The instant disclosure has a configuration that the centre of the low-frequency diaphragm forms the central through hole. The low-frequency diaphragm produces low-frequency sound waves toward the sound output hole by vibrations of the annular vibrating portion. The high-frequency speaker unit independent from the low-frequency speaker unit produces high-frequency sound waves. The high-frequency speaker unit is coaxial to and is disposed in the central through hole. The high-frequency speaker unit and low-frequency speaker unit are coaxial to each other. The high-frequency speaker unit can produce concentrative high-frequency sound waves, and the low-frequency speaker unit around the high-frequency speaker unit can independently produce low-frequency sound waves. The low-frequency diaphragm has an independent design that the material of the low-frequency diaphragm is soft enough to meet the requirement for producing low-frequency sound waves by proper vibrating and amplitudes. The high-frequency diaphragm in the high-frequency speaker unit also has an independent design that the material of the high-frequency diaphragm is hard enough to meet the requirement for producing high-frequency sound waves by proper vibrating and amplitudes. One issue of prior arts is that using a single diaphragm without a central through hole for producing full range frequency sound waves requires additional component such as a frequency divider for frequency division. Another issue of prior arts is that the material of the single diaphragm is uniform, which is not suit for converting different ranges of frequencies. A diaphragm properly producing high-frequency sound waves by faster vibrating and lower amplitudes requires harder material, and a diaphragm properly producing low-frequency sound waves by slower vibrating with longer wave lengths requires softer material. Therefore, full range frequency sound waves produced by a single diaphragm has mediocre quality. Features with respect to high-frequency and low-frequency sound waves are hard to be respectively emphasized. As a result, the produced sound waves are not clear and distinct enough. The issues aforementioned can be solved by the instant disclosure. In addition, a gap formed between the coupling hole and the high-frequency speaker unit allows rear sound waves coming from the back of the diaphragm of the speaker unit to pass through, which is of benefit to the reaction of the movement of the diaphragm and to the adjustment of the strength of low-frequency sound waves so that sound waves produced by the headphone can meet the requisite frequency ranges and sound qualities.

The features of the instant disclosure will no doubt become understandable to those of ordinary skill in the art after reading the following detailed description of the preferred embodiment that is illustrated in the various figures and drawings.

DETAILED DESCRIPTION

Figure 1:
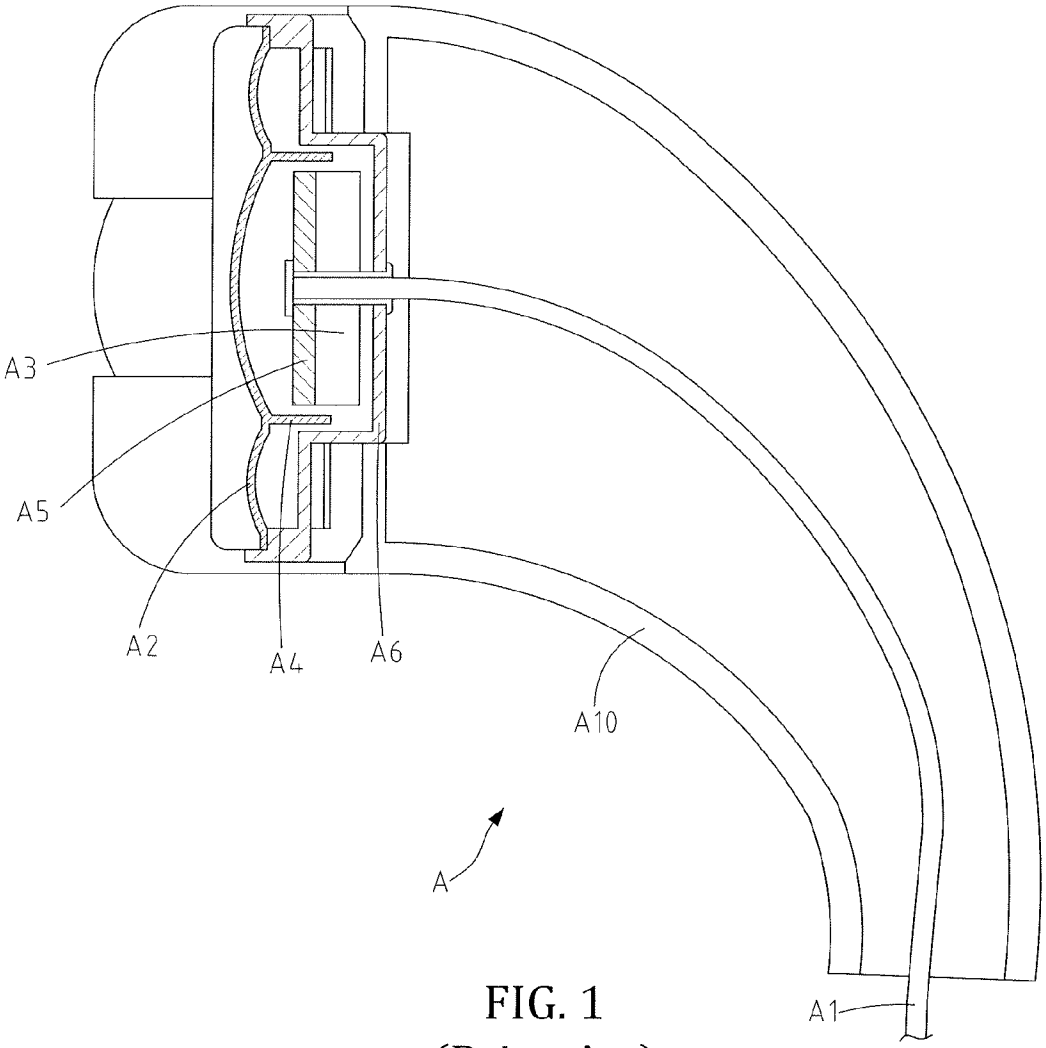
FIG. 1 (Prior Art)
FIG. 1 illustrates a side view of a headphone structure of prior arts.
Figure 2:
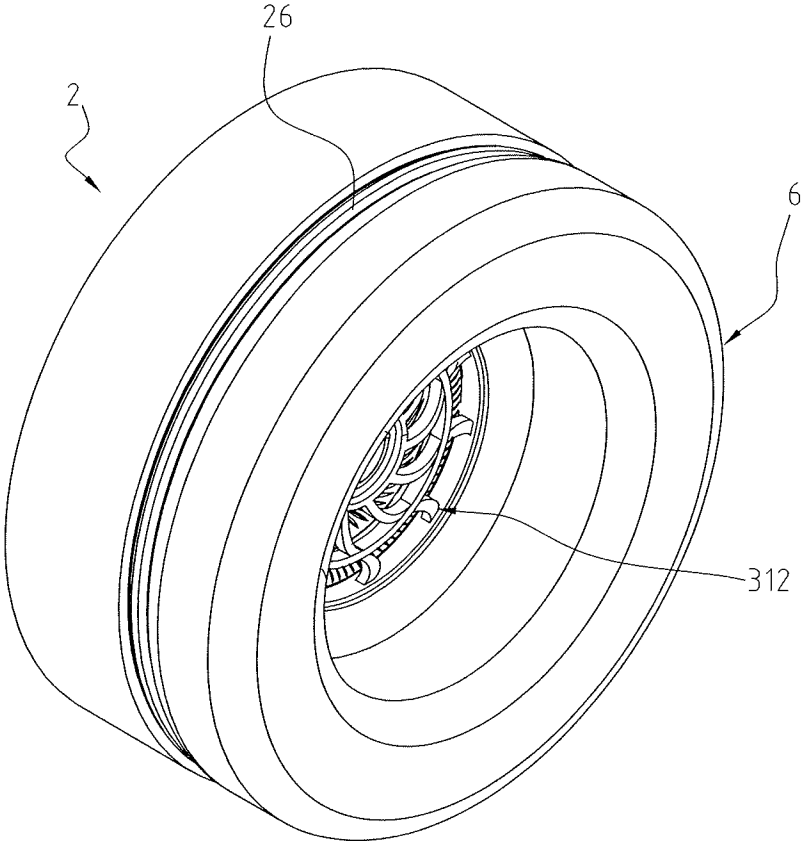
FIG. 2 illustrates a perspective view of a dual-frequency coaxial headphone of the instant disclosure.
Figure 3:
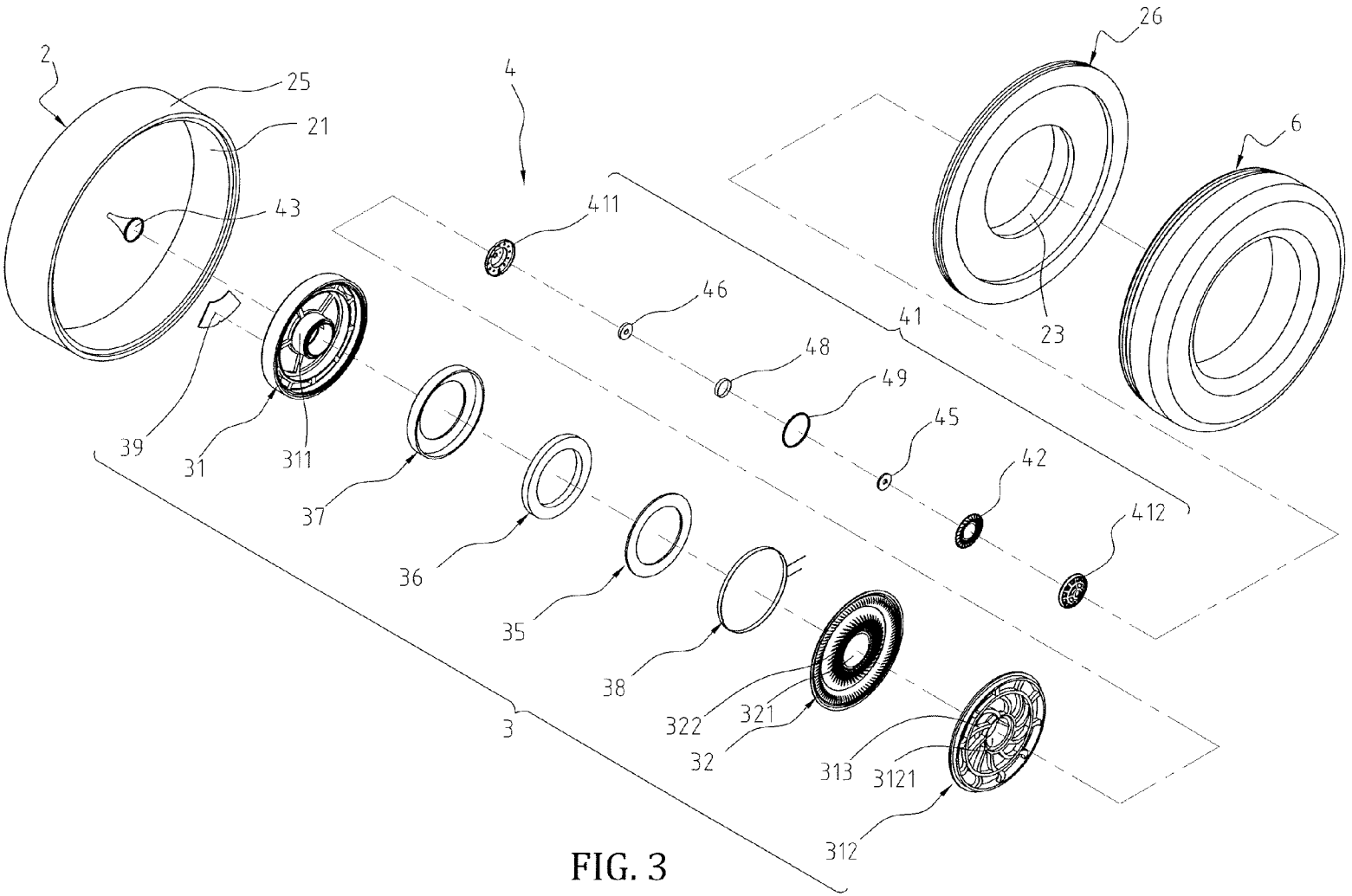
FIG. 3 illustrates an exploded view of the dual-frequency coaxial headphone of the instant disclosure.

FIG. 2 and FIG. 3 illustrate a first embodiment of the instant disclosure. FIG. 2 is a perspective view, and FIG. 3 is an exploded view. Referring to FIG. 2 and FIG. 3, The dual-frequency coaxial headphone 1 includes a headphone housing 2, a low-frequency speaker unit 3, and a high-frequency speaker unit 4. For illustration, the diameter of the headphone 1 is, but is not limited to, 50 mm. In other embodiments of the instant disclosure, the diameter of the headphone 1 can be varied such as 40 mm and 60 mm.

Figure 5:
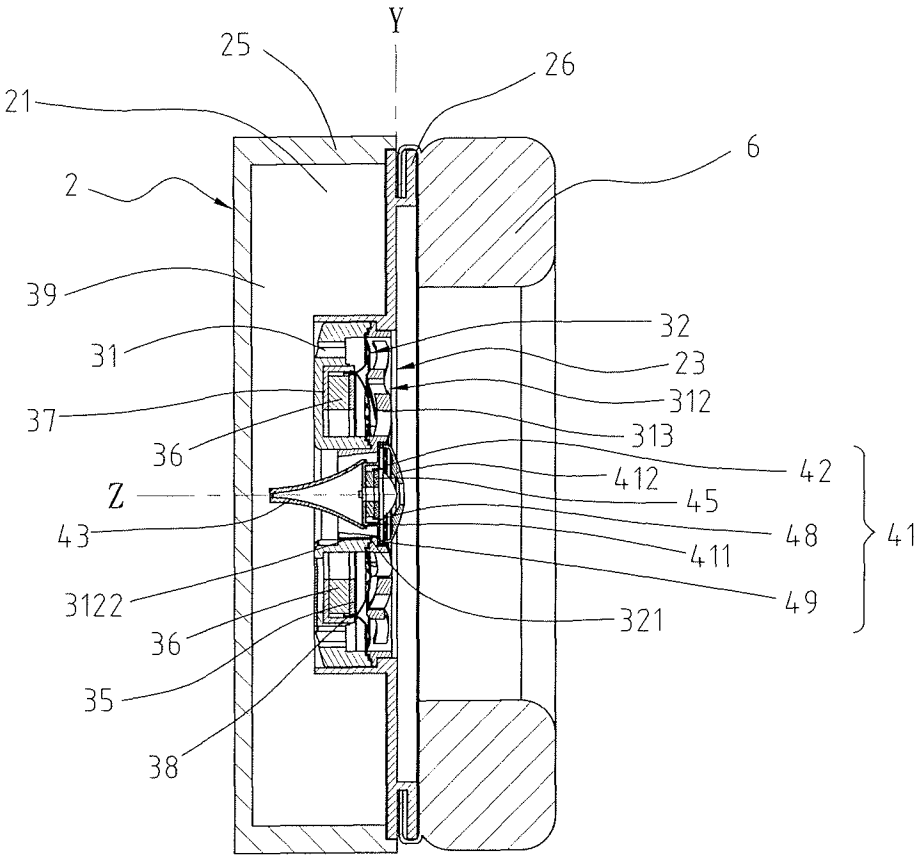
FIG. 5 illustrates a side view of the dual-frequency coaxial headphone of the instant disclosure.

Referring to FIG. 3 and FIG. 5, the headphone housing 2 is composed of plural components. In other embodiment, the headphone housing 2 can be a one-piece component. The low-frequency speaker unit 3 and the high-frequency speaker unit 4 are modularized to be assembled to each other into a single component for being easily connected to the headphone housing 2. In the embodiment, the headphone housing 2 is composed of plural components including a body 25 and speaker mount 26. The body 25 has a shape of a case having an opening aside. The speaker mount 26 covers the body 25. The headphone housing 2 includes an accommodating space 21 and a sound output hole 23 being communicated with each other. The accommodating space 21 is formed in the body 25. The sound output hole 23 is disposed in the centre of the speaker mount 26. In the phase that the speaker mount 26, the body 25, and other components are assembled together, the front sound output hole 23 and the rear accommodating space 21 (rear cavity) are separated and isolated by other components. In addition, the headphone housing 2 further includes an ear pad 6. The ear pad 6 covers a periphery of the speaker mount 26, which can be configured to circumaural headphones (i.e., full size headphones) or supra-aural headphones.

Figure 6:
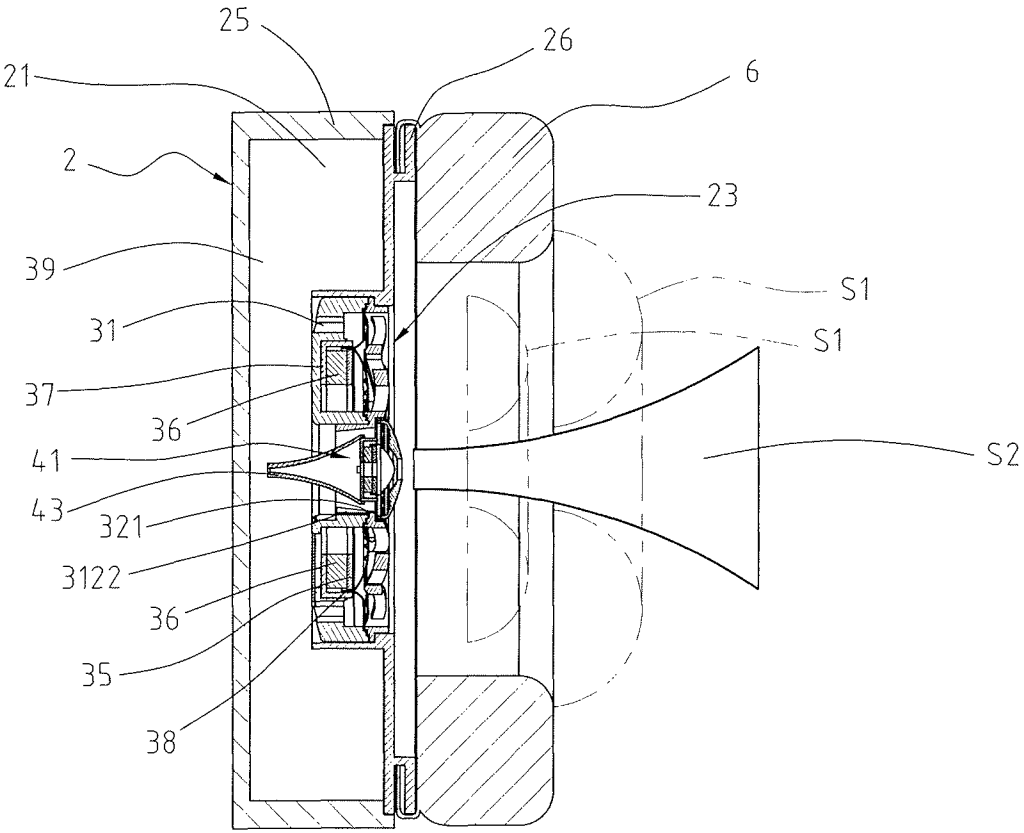
FIG. 6 illustrates a side view of the dual-frequency coaxial headphone with diagrammatic low-frequency and high-frequency sound waves of the instant disclosure.

Referring to FIG. 3 and FIG. 5, the low-frequency speaker unit 3 is positioned in the accommodating space 21 (i.e., the low-frequency speaker unit 3 is mounted in the sound output hole 23 of the speaker mount 26). The low-frequency speaker unit 3 includes a speaker unit housing 31 and a low-frequency diaphragm 32. The speaker unit housing 31 is composed of a case 311 made by aluminum having an opening aside, and a protective net 312. The case 311 includes plural holes formed on the bottom away from the opening for allowing the passage of lines. The protective net 312 is a cover structure having an annular shape. The protective net 312 is connected to the case 311 and covers the opening of the case 311. The periphery of the protective net 312 covers the periphery of the low-frequency diaphragm 32 so that the low-frequency diaphragm 32 is against and fastened to the case 311. In addition, the protective net 312 includes a coupling hole 3121. The high-frequency speaker unit 4 is disposed in the coupling hole 3121. The protective net 312 includes plural through holes 313 corresponding to the periphery of the low-frequency diaphragm 32 and allowing low-frequency sound waves S1 to pass through, as shown in FIG. 6.

Referring to FIG. 3 and FIG. 5, the low-frequency diaphragm 32 has an annular shape. The low-frequency diaphragm 32 is disposed on the speaker unit housing 31, and faces toward the sound output hole 23. The low-frequency diaphragm 32 includes a central through hole 321 and an annular vibrating portion 322 around the central through hole 321. The coupling hole 3121 of the protective net 312 is corresponding to and can be coaxial to the central through hole 321. The low-frequency diaphragm 32 produces low-frequency sound waves S1 toward the sound output hole 23 by vibrations of the annular vibrating portion 322. The low-frequency sound waves S1 are outputted from the annular vibrating portion 322 and spread outwardly in an annular form. A central area of the annular low-frequency sound waves S1 is the area that the low-frequency sound waves S1 are not produced. During the vibration of the annular vibrating portion 322, front sound waves and rear sound waves are accordingly produced and outputted. The front sound waves are outputted in a direction toward the sound output hole 23. The rear sound waves are outputted in a direction away from the sound output hole 23 (i.e., toward the inner of the headphone housing 2).

Referring to FIG. 3 and FIG. 5, the low-frequency speaker unit 3, for illustration, is a moving coil drive unit in the embodiment. The low-frequency speaker unit 3 further includes a washer 35, an annular magnet 36, an outer yoke 37, and a voice coil 38. The annular magnet 36 is positioned in the outer yoke 37. The washer 35 is positioned on a surface of the annular magnet 36. The voice coil 38 is assembled to the low-frequency diaphragm 32. An inner side of the voice coil 38 surrounds and is coupled to the washer 35, and an outer side of the voice coil 38 is positioned on the outer yoke 37. In addition, the low-frequency speaker unit 3 further includes a circuit board 39. The circuit board 39 is disposed in the accommodating space 21. The circuit board 39 is connected to lines and is electrically connected to the outer yoke 37.

Figure 4:
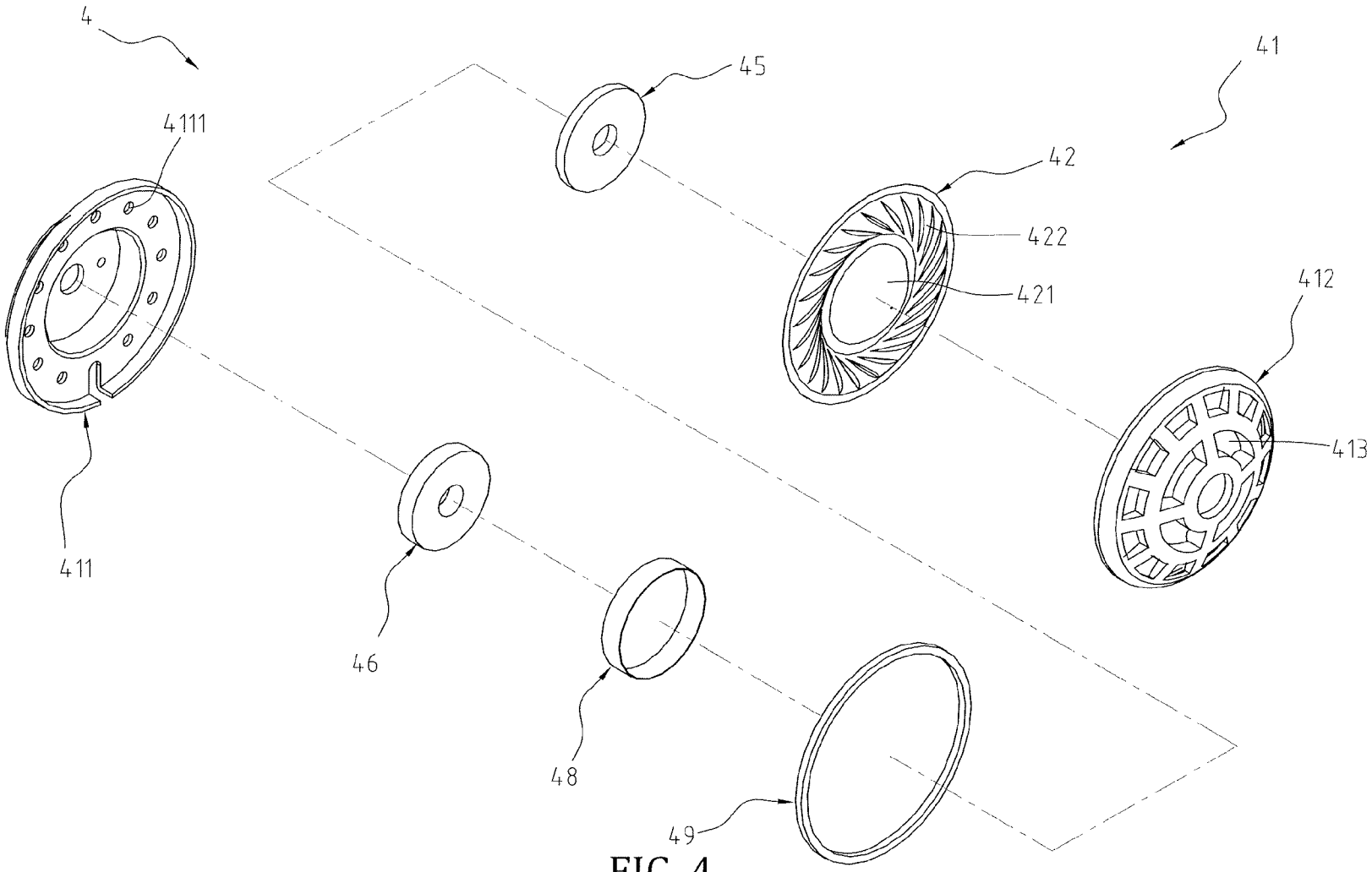
FIG. 4 illustrates an exploded view of a high-frequency speaker unit of the instant disclosure.

Referring to FIG. 4 and FIG. 5, the high-frequency speaker unit can be a moving iron drive unit (also known as a balanced armature drive unit or a piezoelectric ceramic drive unit) or a directivity high-frequency drive unit. The high-frequency speaker unit 4 is disposed on the speaker unit housing 31 of the low-frequency speaker unit 3. The high-frequency speaker unit 4 is positioned in the central through hole 321. The high-frequency speaker unit 4 faces toward the sound output hole 23. The central axis of the high-frequency speaker unit 4, which is the same as the Z axis shown in FIG. 5, is coaxial to that of the central through hole 321. The central axis of the high-frequency speaker unit 4 is also coaxial to that of the sound output hole 23 of the headphone housing 2.

Referring to FIG. 4 and FIG. 5, one face of the high-frequency speaker unit 4 and one face of low-frequency speaker unit 3 are in a same plane, which vertically passes the Y axis shown in FIG. 5. Namely, one face of the high-frequency speaker unit 4 is aligned with the surface of the protective net 312. As shown in FIG. 6, one face of the high-frequency speaker unit 4 produces high-frequency sound waves S2 toward the sound output hole 23 (i.e., toward the ear of a user of the headphone 1). Namely, high-frequency sound waves S2 are concentrated in the central area of the annular low-frequency sound waves S1 and are outputted toward outside. The other face of the high-frequency speaker unit 4 faces toward the inner of the headphone housing 2 (i.e., toward the accommodating space 21). Because the high-frequency speaker unit 4 is coaxial to the central through hole 321 (i.e., coaxial to the Z axis), and one face of the high-frequency speaker unit 4 and one face of low-frequency speaker unit 3 are in a same plane (i.e., the plane passing the Y axis), issues in terms of phase difference between the low-frequency speaker unit 3 and the high-frequency speaker unit 4 are no longer exist.

Referring to FIG. 3, FIG. 4, and FIG. 5, the high-frequency speaker unit 4 is disposed in the coupling hole 3121. The high-frequency speaker unit 4 comprises a speaker unit housing 41 and a high-frequency diaphragm 42. The speaker unit housing 41 includes a case 411 of which the material is iron and having an opening aside, and a protective net 412. The case 411 includes plural tuning holes 4111 formed on the bottom away from the opening of the case 411. The protective net 412 is a cover structure having an annular shape. The protective net 412 is connected to the case 411 and covers the opening of the case 411. The periphery of the protective net 412 covers the periphery of the high-frequency diaphragm 42 so that the high-frequency diaphragm 42 is against and fastened to the case 411. The protective net 412 includes plural through holes 413 corresponding to the periphery of the high-frequency diaphragm 42 and allowing high-frequency sound waves S2 to pass through, as shown in FIG. 6. In addition, the high-frequency speaker unit 4 includes a guiding tube 43. One side of the guiding tube 43 surrounds and is coupled to the speaker unit housing 41, and the other side of the guiding tube 43 extends to the accommodating space 21.

Referring to FIG. 3, FIG. 4, and FIG. 5, the high-frequency diaphragm 42 has an annular structure. The high-frequency diaphragm 42 is disposed on the speaker unit housing 41 and faces toward the sound output hole 23. The high-frequency diaphragm 42 includes a central vibrating portion 421 and an annular vibrating portion 422 around the central vibrating portion 421. The high-frequency diaphragm 42 produces high-frequency sound waves S2 toward the sound output hole 23 by vibrations of the central vibrating portion 421 and the annular vibrating portion 422.

Referring to FIG. 4 and FIG. 5, the high-frequency speaker unit 4 in the embodiment further includes a washer 45, an annular magnet 46, a voice coil 48, and a fixing ring 49. The annular magnet 46 is positioned in the case 411. The washer 45 is positioned on a surface of the annular magnet 46. The fixing ring 49 is positioned in the case 411 and against a periphery of the high-frequency diaphragm 42. The voice coil 48 is assembled to the high-frequency diaphragm 42. An inner side of the voice coil 48 surrounds and is coupled to the washer 45, and a periphery of the voice coil 48 is positioned on the case 411.

Referring to FIG. 4 to FIG. 6, after the high-frequency speaker unit 4 is mounted to the coupling hole 3121 of the protective net 312, a gap 3122 for air flowing is formed between the coupling hole 3121 and the high-frequency speaker unit 4. The centre of the annular low-frequency sound waves S1 is an area in which no low-frequency sound waves S1 are produced. The air can flow through the gap 3122 between the coupling hole 3121 and the high-frequency speaker unit 4 and into the central through hole 321. If the space in the headphone housing 2 is entirely sealed, the sound waves cannot disperse so that the operation of the speaker unit may have negative effect. The gap 3122 formed between the coupling hole 3121 and the high-frequency speaker unit 4 allows rear sound waves coming from the low-frequency diaphragm 32 of the low-frequency speaker unit 3 to pass through, which is of benefit to the reaction of the movement of the diaphragm and to the adjustment of the strength of low-frequency sound waves so that sound waves produced by the headphone 1 can meet the requisite frequency ranges and sound qualities. In some embodiments, after the high-frequency speaker unit 4 is mounted to the coupling hole 3121 of the protective net 312, the high-frequency speaker unit 4 seals the coupling hole 3121. In other words, there is no gap for air flowing between the coupling hole 3121 and the high-frequency speaker unit 4.

The instant disclosure has a configuration that the centre of the low-frequency diaphragm forms the central through hole. The low-frequency diaphragm produces low-frequency sound waves toward the sound output hole by vibrations of the annular vibrating portion. The high-frequency speaker unit independent from the low-frequency speaker unit produces high-frequency sound waves. The high-frequency speaker unit is coaxial to and is disposed in the central through hole. The high-frequency speaker unit and low-frequency speaker unit are coaxial to each other. The high-frequency speaker unit can produce concentrative high-frequency sound waves, and the low-frequency speaker unit around the high-frequency speaker unit can independently produce low-frequency sound waves. The low-frequency diaphragm has an independent design that the material of the low-frequency diaphragm is soft enough to meet the requirement for producing low-frequency sound waves by proper vibrating and amplitudes. The high-frequency diaphragm in the high-frequency speaker unit also has an independent design that the material of the high-frequency diaphragm is hard enough to meet the requirement for producing high-frequency sound waves by proper vibrating and amplitudes. One issue of prior arts is that using a single diaphragm without a central through hole for producing full range frequency sound waves requires additional component such as a frequency divider for frequency division. Another issue of prior arts is that the material of the single diaphragm is uniform, which is not suit for converting different ranges of frequencies. A diaphragm properly producing high-frequency sound waves by faster vibrating and lower amplitudes requires harder material, and a diaphragm properly producing low-frequency sound waves by slower vibrating with longer wave lengths requires softer material. Therefore, full range frequency sound waves produced by a single diaphragm has mediocre quality. Features with respect to high-frequency and low-frequency sound waves are hard to be respectively emphasized. As a result, the produced sound waves are not clear and distinct enough. The issues aforementioned can be solved by the instant disclosure. In addition, a gap formed between the coupling hole and the high-frequency speaker unit allows rear sound waves coming from the back of the diaphragm of the speaker unit to pass through, which is of benefit to the reaction of the movement of the diaphragm and to the adjustment of the strength of low-frequency sound waves so that sound waves produced by the headphone can meet the requisite frequency ranges and sound qualities.

While the instant disclosure has been described by way of example and in terms of the preferred embodiments, it is to be understood that the instant disclosure needs not be limited to the disclosed embodiments. For anyone skilled in the art, various modifications and improvements within the spirit of the instant disclosure are covered under the scope of the instant disclosure. The covered scope of the instant disclosure is based on the appended claims.

What is claimed is:

1. A dual-frequency coaxial headphone, comprising:

a headphone housing comprising an accommodating space and a sound output hole, the accommodating space being communicated with the sound output hole;

a low-frequency speaker unit disposed in the headphone housing and positioned in the accommodating space, the low-frequency speaker unit comprising a first speaker unit housing and a low-frequency diaphragm disposed on the first speaker unit housing, the low-frequency diaphragm facing toward the sound output hole and comprising a central through hole and an annular vibrating portion around the central through hole, the low-frequency diaphragm producing low-frequency sound waves toward the sound output hole by vibrations of the annular vibrating portion; and a high-frequency speaker unit disposed on the first speaker unit housing and positioned in the central through hole, the high-frequency speaker unit being coaxial to the central through hole, one face of the high-frequency speaker unit producing high-frequency sound waves toward the sound output hole and concentrating in a central area of the low-frequency sound waves, the other face of the high-frequency speaker unit facing toward the inner of the headphone housing, the high-frequency speaker unit comprising a guiding tube and a second speaker unit housing, wherein one side of the guiding tube surrounds and is coupled to the second speaker unit housing, and the other side of the guiding tube extends to the accommodating space;

wherein one face toward the sound output hole of the high-frequency speaker unit and one face toward the sound output hole of the low-frequency speaker unit are in a same plane.

2. The dual-frequency coaxial headphone of claim 1, wherein the headphone housing comprises a body, a speaker mount covering the body, and an ear pad covering the speaker mount, the accommodating space is formed in the body, and the sound output hole is disposed in the centre of the speaker mount.

3. The dual-frequency coaxial headphone of claim 1, wherein the first speaker unit housing comprises a case and a protective net, and the protective net covers the low-frequency diaphragm so that the low-frequency diaphragm is against the case.

4. The dual-frequency coaxial headphone of claim 3, wherein the protective net comprises a coupling hole corresponding to the central through hole, and the high-frequency speaker unit is disposed in the coupling hole.

5. The dual-frequency coaxial headphone of claim 4, wherein a gap for air flowing is formed between the coupling hole and the high-frequency speaker unit.

6. The dual-frequency coaxial headphone of claim 1, wherein the high-frequency speaker unit comprises a high-frequency diaphragm disposed on the second speaker unit housing.

7. The dual-frequency coaxial headphone of claim 6, wherein the second speaker unit housing of the high-frequency speaker unit comprises a case and a protective net, and the protective net covers the high-frequency diaphragm so that the high-frequency diaphragm is against the case.

8. The dual-frequency coaxial headphone of claim 7, wherein the high-frequency speaker unit further comprises a washer and an annular magnet, the annular magnet is positioned in the case, and the washer is positioned on a surface of the annular magnet.

9. The dual-frequency coaxial headphone of claim 8, wherein the high-frequency speaker unit further comprises a fixing ring positioned in the case and against a periphery of the high-frequency diaphragm.

10. The dual-frequency coaxial headphone of claim 8, wherein the high-frequency speaker unit further comprises a voice coil assembled to the high-frequency diaphragm, and the voice coil surrounds and is coupled to the washer.

11. The dual-frequency coaxial headphone of claim 1, wherein the low-frequency speaker unit further comprises a washer, an annular magnet, and an outer yoke, the annular magnet is positioned in the outer yoke, and the washer is positioned on a surface of the annular magnet.

12. The dual-frequency coaxial headphone of claim 11, wherein the low-frequency speaker unit further comprises a voice coil assembled to the low-frequency diaphragm, and the voice coil surrounds and is coupled to the washer.

13. The dual-frequency coaxial headphone of claim 11, wherein the low-frequency speaker unit further comprises a circuit board disposed in the accommodating space and electrically connected to the outer yoke.

* * * * *